United States Patent [19]

Mehta et al.

[11] 4,179,454

[45] Dec. 18, 1979

[54] PRODUCTION OF HYDROGENATED FATTY ACIDS FROM CRUDE GLYCERIDE OILS

[75] Inventors: Anil B. Mehta, Strongsville; Richard J. Zielinski, Middleburg Heights, both of Ohio

[73] Assignee: SCM Corporation, Cleveland, Ohio

[21] Appl. No.: 927,452

[22] Filed: Jul. 24, 1978

[51] Int. Cl.[2] ..... C11C 3/12; C11C 1/04

[52] U.S. Cl. ..... 260/409; 260/415; 260/416; 260/417; 260/418; 260/419

[58] Field of Search ..... 260/409, 415, 416, 417, 260/418, 419

[56] References Cited

U.S. PATENT DOCUMENTS

| | | | |
|---|---|---|---|
| 2,413,009 | 12/1946 | Taussky | 260/419 X |
| 2,682,549 | 6/1954 | Kirschenbauer | 260/409 |
| 3,856,710 | 12/1974 | Moulton et al. | 260/409 X |

*Primary Examiner*—John F. Niebling

*Attorney, Agent, or Firm*—Merton H. Douthitt; Gordon P. Becker

[57] ABSTRACT

Hydrogenated fatty acids are produced by hydrogenating a crude glyceride oil and splitting the resulting hydrogenated crude glyceride oil into component hydrogenated fatty acid and glycerine.

10 Claims, No Drawings

PRODUCTION OF HYDROGENATED FATTY ACIDS FROM CRUDE GLYCERIDE OILS

BACKGROUND OF THE INVENTION

The present invention relates to production of fatty acids and more particularly to a method for producing hydrogenated fatty acids directly from crude or unrefined glyceride oils.

Presently, fatty acids are recovered by conventional fat-splitting techniques which are commonly practiced on refined glyceride oils. Fatty acids can be used in the acid form or they can be esterified, interesterified, polymerized, or subjected to a wide variety of techniques for producing products useful in pharmaceuticals, cosmetics, the textile industry, the rubber industry, and a wide variety of other industries.

The present invention permits production of hydrogenated fatty acids without the cumbersome alkali degumming or refining step and eliminates the difficult fatty acid hydrogenation step normally required for production of hydrogenated fatty acids.

BROAD STATEMENT OF THE INVENTION

The present invention is a process for producing hydrogenated fatty acids. The process comprises hydrogenating a crude or unrefined glyceride oil in the hydrogenation zone under hydrogenation conditions with hydrogen gas in the presence of a hydrogenation catalyst. The hydrogenation step is discontinued after at least a significant increase in saturation of the oil has occurred. The resulting hydrogenated crude oil then is passed into a splitting zone and therein is split into component hydrogenated fatty acid and glycerine.

DETAILED DESCRIPTION OF THE INVENTION

The crude oil is catalytically hydrogenated in the presence of a hydrogenation catalyst. Acceptable hydrogenation catalysts include supported palladium, preferably upon a charcoal, alumina, Kiegelsguhr, or similar support. Other possible useful catalysts include platinum, iridium, rhodium, ruthenium, and even nickel if metal soap formation during the hydrogenation process can be tolerated. Of course, combinations of these catalysts can be used as is necessary, desirable, or convenient. Suitable catalysts should have a substantially high vapor pressure in the hydrogenation process so that they are retained in the heated oil during the process. Preferably, though, the crude oil hydrogenation process is conducted according to the Hasman process as disclosed in commonly assigned application Ser. No. 896,508, filed Apr. 17, 1978, entitled "Hydrogenation of Unrefined Glyceride Oils", the disclosure of which is expressly incorporated herein by reference.

In the Hasman hydrogenation process, crude glyceride oil is subjected to hydrogenation in the presence of greater than 0.02 weight percent nickel hydrogenation catalyst and of greater than about 0.2 weight percent copper chromite adjunct catalyst. In the process, the concentration of the adjunct catalyst is established and maintained broadly proportional to the concentration of contaminants in the crude oil. Generally, the adjunct catalyst is present in the zone in an amount which can range up to about 3 weight percent or higher depending upon the concentration of contaminants in the feed oil. A preferable range for the adjunct catalyst is between about 1 and about 3% by weight of the oil being subjected to the hydrogenation step. The nickel catalyst can range from about 0.025 to about 0.3 weight percent or higher. At these higher levels of nickel catalyst, such hydrogenation process proceeds very rapidly regardless of the ultimate IV of the hydrogenated product desired. In this application, all catalyst percentages are by weight of the active metal, metal oxide or the like or mixtures thereof, i.e. not including catalyst supports, protective catalyst packings (eg. stearine), or the like.

An especially useful embodiment of the Hasman process is a two-stage hydrogenation process which utilizes the disclosed catalyst/adjunct catalyst combination as a primary stage to hydrogenate the crude oil to an intermediate IV, where determination of the intermediate IV depends upon several factors, two of the more influential factors being contaminant concentration in the feed crude oil and initial IV of the feed oil. As to the latter factor, it is disclosed that the intermediate IV should be at least about 10% lower than the initial IV of the oil fed to the primary hydrogenation zone and this figure is particularly applicable to feed oils having an initial IV of around 10 to 30 or somewhat higher. For feed crude oils having an initial IV of around 50 to 100 and especially for oils of around 100 to 200 IV, there is a rather wide range of intermediate Iodine Values which permit the practical and rapid hydrogenation according to such process. An intermediate IV of around 90 to 100 or thereabouts has been found to be advantageous and results in a much improved secondary hydrogenation stage which utilizes only a nickel hydrogenation catalyst.

During the secondary hydrogenation the concentration of nickel catalyst ranges from about 0.01 to about 0.30 weight percent, advantageously between about 0.05 and about 0.20 weight percent, and preferably between about 0.05 and about 0.15 weight percent. Evidently, the catalyst/adjunct catalyst combination of the primary hydrogenation step has sufficiently suppressed the effect of the contaminants in the crude oil that the need for the adjunct catalyst during the secondary hydrogenation is found to be unnecessary and costly, and even may slow the reaction rate down.

Raw or crude glyceride oils contain a variety of contaminants which display a substantial depressant effect in hydrogenation processes by poisoning the hydrogenation catalyst, thus rendering it ineffective in the hydrogenation process. Typically such contaminants amount to about 5% by weight or less than the unrefined oil, though this figure can vary substantially depending upon the particular type of oil and its source. An advantage of using the Hasman process for hydrogenating the crude oil is that the proportion of contaminant phosphatides can be substantially reduced by the process to a level approximating that which commercial degummed crude oils typically contain. Thus, a type of refining action also apparently occurs during such hydrogenation process. For a more complete treatise on glyceride oils and analysis of contaminants indiginous to raw glyceride oils, reference is had to *Bailey's Industrial Oil and Fat Products,* 3rd Edition, especially pages 1–53 (Interscience Publishers, New York, N.Y. 1964), the disclosure of which is expressly incorporated herein by reference.

Crude, raw, or unrefined oil, as such terms are used herein, comprehends a glyceride oil which has not been subjected to conventional refining techniques such as alkali refining or the like. It is, however, within the scope of this invention to include crude oils which have been subjected to a like degumming operation for lowering the level of phosphatides and other gums, slimes or mucilaginous material, but where the acidity of the oil is not significantly reduced. Conventional degumming includes treatment of the crude oil with water, weak boric acid, sodium chloride, or like variety of other agents well known in the art. Drying of the oils to remove water also is a contemplated desirable operation. Deacidification of the crude oil may be practiced also, though such operation is not necessary. Broadly, the level of contaminants in the crude oil conveniently is measured by the level of phosphatides contained therein and such measurement will be used for purposes of the present invention. Broadly, a phosphatide level of not substantially above about 2% by weight is desired and most crude oils do not exceed this level of phosphatides. Advantageously, the level of phosphatides is less than about 1.5%, and preferably less than about 1% by weight of the crude oil. Lower phosphatide levels permit enhanced efficiency and speed in the hydrogenation process. Usually, the proportion of phosphatides in the crude oil is greater than about 0.01% and more often greater than about 0.1% by weight. Adjustment of the copper chromite adjunct catalyst in the preferred hydrogenation embodiment of this invention broadly proportional to the level of contaminants in the oil (conveniently measured by the level of phosphatides in the oil) can effectively suppress the depressant effect which such contaminants have on the hydrogenation process.

For present purposes, a "significant increase in saturation of the oil" means that the final IV of the oil is less than about 100 and such IV can range broadly between 0 and 100. For producing a hydrogenated fatty acid product which is substantially fully hydrogenated, the final IV of the hydrogenated crude oil should be less than 30 broadly and preferably less than 10. For practice of the two-step embodiment of the Hasman process, a significant increase in saturation of the oil from primary hydrogenation means at least about a 10% reduction of the IV of the oil fed to the process. Several other factors which affect the hydrogenation process of crude oils besides contaminants in the feed oil such as phosphatides, iron, free fatty acid and the like, include hydrogenation conditions such as temperature and hydrogenation gas pressure; concentration of catalyst in the hydrogenation zones; efficiency and extent of catalyst compact with the hydrogen gas and oil, typically controlled by mixing or the like; mode of operation of the process, i.e. batch or continuous operation; and other factors known in the art. Adjustment and balance of these factors can be delicate at times, though proper design of a hydrogenation process reduced the number of variables to but a few for ease of control and efficiency of the overall process.

Typical sources of the oil are vegetable oil (including nut), animal fat, fish oil and the like. Vegetable oils include the oils of coconut, corn, cottonseed, linseed, olive, palm, palm kernel, peanut, safflower, soybean, sunflower, and the like vegetable oils.

Hydrogenation operations comprise charging the unrefined oil into a hydrogenation reactor having a hydrogenation zone therein. Hydrogenation conditions for contacting hydrogen gas with the crude oil typically include temperatures of about 100° to about 300° C. and pressures of about 0 to about 300 psig, and preferably about 0 to 100 psig.

The thus-hydrogenated crude oil after discontinuance of the hydrogenation step, then is passed into an oil splitting zone and therein split into component fatty acid and glycerine. A wide variety of so-called "fat splitting" processes are well-known in the art. Among those historically used include caustic splitting of the fat and the Twitchell process. Today, though, most commercial fat splitting processes employ the high pressure, high temperature hydrolysis of the oil. Such fat splitting processes are well known in the art and a good description of them can be found in *Bailey's Industrial Oil and Fat Products,* pages 931–972, supra; *Kirk-Othmer Encyclopedia of Chemical Technology,* 2nd Edition, Vol. 8, pages 811–845, Interscience Publishers, New York, N.Y. (1965); and Pattison, *Fatty Acids and Their Industrial Applications,* pp. 25–29, Marcel Dekko, Inc., New York, N.Y. (1968); the disclosures of these references being expressly incorporated herein by reference.

Following the splitting of the hydrogenated crude oil to component hydrogenated fatty acid and glycerine, the recovered fatty acid can be refined by a variety of techniques depending upon the particular composition of fatty acid desired and ultimate use thereof. Commonly, the recovered fatty acid is fractionated either by crystallization techniques (solvent or non-solvent fractional crystallization) according to various unsaturated fatty acid components therein, or by distillation including molecular distillation which separates component fatty acids broadly according to molecular weight. Practice of these fractionation processes are well known in the art. The fatty acids also can be dried, bleached, eg. with conventional bleaching clays, diatomaceous earths, or the like, in order to improve their color and odor, and/or vacuum distilled including steam distillation to purify the fatty acids. Typically, such distillation is practiced at about 150° to 250° C. under a total pressure of less than 50 mm-Hg and preferably between about 0.1 and 20 mm-Hg.

The following example shows how the present invention can be practiced but should not be construed as limiting. In this application all temperatures are in degrees Centigrade and all percentages are weight percentages unless otherwise expressly indicated.

EXAMPLE

A crude, non-degummed soybean oil containing 1.6% phosphatides was hydrogenated to a final Iodine Value of 1.1 (calculated) by the two-stage hydrogenation process of Hasman reported in commonly assigned co-pending application Ser. No. 896,508, filed Apr. 17, 1978, Example 4, run 2. The resulting soybean stearine was filtered to remove the nickel hydrogenation catalyst used in the secondary hydrogenation stage.

The stearine then was passed into a fat-splitting vessel and saponified with a 50% aqueous sodium hydroxide solution. The proportion of NaOH used was a 25% excess calculated from the saponification value of the stearine (183 saponification value). The caustic solution was added slowly to a mixture of the stearine and water (80° C., 1:7 weight ratio stearine to water) under vigorous agitation. The caustic addition was controlled so that the resulting exotherm of this exothermic reaction did not cause the reaction temperature to exceed 80° C. The reaction temperature could not exceed about 100° C. otherwise loss of water at the reaction pressure of 1 atmosphere total pressure would result.

To the saponified stearine a 50% aqueous sulfuric acid solution slowly was added so that the reaction temperature did not exceed 80° C. The amount of sulfuric acid added to spring the fatty acids was a 25% excess of the stoichiometric amount required to acidulate the soapstock based on the moles of caustic used to saponify the stearine.

The liberated fatty acids were water washed until the pH of the resulting water layer was between 5 and 7. The fatty acids then were dried under vacuum at 100° C. and bleached with 1% Filtrol 105 bleaching earth (a product of Filtrol Corporation) for 1 hour. After filtration of the bleaching earth, the fatty acids were steam distilled at a temperature up to 240° C. maximum temperature and 0.1 mm. of mercury pressure. A recovery of 97% of fatty acids was obtained from the steam distillation step.

The following tables display the analytical results obtained:

TABLE I

| Fatty Acid Content: No. Double Bonds | Soybean Stearine (wt-%) | Distilled Soybean Stearine Fatty Acids (wt-%) |
|---|---|---|
| C14:0 | 0.1 | 0.1 |
| C16:0 | 10.7 | 10.9 |
| C17:0 | 0.2 | 0.2 |
| C18:0 | 87.3 | 86.9 |
| C18:1 | 1.3 | 1.4 |
| C20:0 | 0.4 | 0.4 |
| IV(Calculated) | 1.1 | 1.2 |

TABLE II

| | Soybean Stearine | Soybean Stearine Fatty Acids | Distilled Soybean Stearine Fatty Acids |
|---|---|---|---|
| Color (Lovibond, 1 inch tube) | 7R-70Y | 7R-70Y | 0.3R-3Y* |
| % Free Fatty Acid (as oleic acid) | 1.4% | 100.0% | 99.3% |
| % Unsaponifiables | — | 0.52% | 0.13% |

*Color in 5.25 inch tube

The color of the bleached soybean stearine fatty acids was determined to be 4R-41Y (Lovibond, 1 inch tube) prior to distillation)

It should be noted that the 97% recovery of fatty acids from the distillation step is an important benefit of the process especially in view of the excellent color which the distilled fatty acids have. It should be remembered that the feed oil was an unrefined, non-degummed oil containing 1.6% phosphatides. The distilled fatty acids are of suitable quality to be used without further processing or they can be further purified for specialized use.

I claim:

1. A process for producing hydrogenated fatty acids which comprises:

subjecting a crude glyceride oil to hydrogenation in a hydrogenation zone with hydrogen gas under hydrogenation conditions in the presence of a hydrogenation catalyst;

discontinuing said hydrogenation after at least a significant increase in saturation of said oil has occurred;

passing said hydrogenated crude oil into a splitting zone and therein splitting said hydrogenated oil under oil splitting conditions into component hydrogenated fatty acids and by-product glycerine; and withdrawing said hydrogenated fatty acids and said by-product glycerine from said splitting zone.

2. The process of claim 1 wherein said withdrawn fatty acids are refined.

3. The process of claim 2 wherein said refining includes bleaching, fractional crystallization, and/or distillation of said fatty acids.

4. The process of claim 1 wherein no alkali refining of said oil is practiced.

5. The process of claim 1 wherein said hydrogenation is conducted in the presence of between about 0.025% to 0.3% nickel catalyst and of between about 0.2% and 3% copper chromite adjunct catalyst, said catalyst percentages based on the weight of said oil.

6. The process of claim 5 wherein the Iodine Value of said hydrogenated fatty acids is between 100 and 0.

7. The process of claim 6 wherein said withdrawn fatty acids are refined.

8. The process of claim 7 wherein said refining includes bleaching, fractional crystallization, and/or distillation of said fatty acids.

9. The process of claim 5 wherein said hydrogenation is discontinued when the IV of the oil is at least 10% less than the IV of the oil fed to the process, at least said adjunct catalyst separated from said oil, and said oil subjected to a second hydrogenation under hydrogenation conditions in the presence of between about 0.01 and 0.3 weight percent nickel catalyst.

10. The process of claim 9 wherein the withdrawn fatty acids have an Iodine Value of between about 30 and 0, and are refined by bleaching, fractional crystallization, and/or distillation.

* * * * *